US010550455B2

(12) United States Patent
Hosch et al.

(10) Patent No.: US 10,550,455 B2
(45) Date of Patent: Feb. 4, 2020

(54) METHODS OF CONTINUOUSLY CASTING NEW 6XXX ALUMINUM ALLOYS, AND PRODUCTS MADE FROM THE SAME

(71) Applicant: ALCOA INC., Pittsburgh, PA (US)

(72) Inventors: Timothy A. Hosch, Plum, PA (US); John M. Newman, Export, PA (US); David Allen Tomes, Jr., San Antonio, TX (US)

(73) Assignee: ARCONIC INC., Pittsburgh, PA (US)

( * ) Notice: Subject to any disclaimer, the term of this patent is extended or adjusted under 35 U.S.C. 154(b) by 584 days.

(21) Appl. No.: 14/957,383

(22) Filed: Dec. 2, 2015

(65) Prior Publication Data

US 2016/0160333 A1 Jun. 9, 2016

Related U.S. Application Data

(60) Provisional application No. 62/087,106, filed on Dec. 3, 2014, provisional application No. 62/131,637, filed on Mar. 11, 2015.

(51) Int. Cl.

| | |
|---|---|
| ***C22C 21/02*** | (2006.01) |
| ***C22F 1/043*** | (2006.01) |
| ***B22D 11/00*** | (2006.01) |
| ***C22F 1/00*** | (2006.01) |

(52) U.S. Cl.

CPC ..... *C22F 1/043* (2013.01); *B22D 11/003* (2013.01); *C22C 21/02* (2013.01); *C22F 1/002* (2013.01)

(58) Field of Classification Search

CPC ..... C22C 21/02; C22F 1/043; C22F 1/002; B22D 11/003

USPC ..... 148/439

See application file for complete search history.

(56) References Cited

U.S. PATENT DOCUMENTS

| | | | | |
|---|---|---|---|---|
| 5,582,660 | A | 12/1996 | Erickson et al. | 148/688 |
| 6,280,543 | B1 | 8/2001 | Zonker et al. | |
| 6,672,368 | B2 | 1/2004 | Unal | 164/480 |
| 2004/0011438 | A1 * | 1/2004 | Lorentzen | C22C 21/00 148/551 |
| 2005/0183801 | A1 | 8/2005 | Unal et al. | 148/694 |
| 2005/0211350 | A1 | 9/2005 | Unal et al. | |
| 2009/0242088 | A1 | 10/2009 | Takaki et al. | 148/693 |

(Continued)

FOREIGN PATENT DOCUMENTS

| | | |
|---|---|---|
| AU | 2014200219 | 1/2014 |
| JP | 2003-089859 | 3/2003 |
| JP | 2003-213356 A | 7/2003 |

(Continued)

OTHER PUBLICATIONS

International Search Report and Written Opinion, dated Feb. 19, 2016, from corresponding International Patent Application No. PCT/US2015/063484.

*Primary Examiner* — Brian D Walck

(74) *Attorney, Agent, or Firm* — Greenberg Traurig, LLP

(57) ABSTRACT

New 6xxx aluminum alloy strips having an improved combination of properties are disclosed. The new 6xxx new aluminum alloy strips are rolled to a target thickness in-line via at least a first rolling stand and a second rolling stand. In one approach, the 6xxx new aluminum alloy strips may contain 0.8 to 1.25 wt. % Si, 0.2 to 0.6 wt. % Mg, 0.5 to 1.15 wt. % Cu, 0.01 to 0.2 wt. % manganese, 0.01 to 0.2 wt. % iron; up to 0.30 wt. % Ti; up to 0.25 wt. % Zn; up to 0.15 wt. % Cr; and up to 0.18 wt. % Zr.

11 Claims, 7 Drawing Sheets

(56) References Cited

U.S. PATENT DOCUMENTS

| | | | | |
|---|---|---|---|---|
| 2013/0164170 | A1 | 6/2013 | Nakai et al. | 420/532 |
| 2014/0000768 | A1 | 1/2014 | Sawtell et al. | 148/551 |

FOREIGN PATENT DOCUMENTS

| | | | |
|---|---|---|---|
| JP | 2004-315878 | A | 11/2004 |
| JP | 2007-254825 | A | 10/2007 |
| JP | 2007-262484 | | 10/2007 |
| JP | 2012-077318 | A | 4/2012 |
| WO | WO03/066927 | | 8/2003 |
| WO | WO2013/188668 | | 12/2013 |

* cited by examiner

METHODS OF CONTINUOUSLY CASTING NEW 6XXX ALUMINUM ALLOYS, AND PRODUCTS MADE FROM THE SAME

CROSS-REFERENCE TO RELATED APPLICATIONS

This patent application claims benefit of priority of U.S. Provisional Patent Application No. 62/087,106, filed Dec. 3, 2014, and claims benefit of priority of U.S. Provisional Patent Application No. 62/131,637, filed Mar. 11, 2015, both entitled "METHODS OF CONTINUOUSLY CASTING NEW 6XXX ALUMINUM ALLOYS, AND PRODUCTS MADE FROM THE SAME", each of which is incorporated herein by reference in its entirety.

BACKGROUND

6xxx aluminum alloys are aluminum alloys having silicon and magnesium to produce the precipitate magnesium silicide ($Mg_2Si$). The alloy 6061 has been used in various applications for several decades. However, improving one or more properties of a 6xxx aluminum alloy without degrading other properties is elusive. For automotive applications, a sheet having good formability with high strength (after a typical paint bake thermal treatment) would be desirable.

SUMMARY OF THE INVENTION

The present invention relates to a method of manufacturing a 6xxx aluminum alloy strip in a continuous in-line sequence comprising (i) providing a continuously-cast aluminum alloy strip as feedstock; (ii) rolling (e.g. hot rolling and/or cold rolling) the feedstock to the required thickness in-line via at least two stands, optionally to the final product gauge. After the rolling, the feedstock may be (iii) solution heat-treated and (iv) quenched. After the solution heat treating and quenching, the 6xxx aluminum alloy strip may be (v) artificially aged (e.g., via a paint bake). Optional additional steps include off-line cold rolling (e.g., immediately before or after solution heat treating), tension leveling and coiling. This method results in an aluminum alloy strip having an improved combination of properties (e.g., an improved combination of strength and formability).

Referring now to FIG. 1, one method of manufacturing a 6xxx aluminum alloy strip is shown. In this embodiment, a continuously-cast aluminum 6xxx aluminum alloy strip feedstock 1 is optionally passed through shear and trim stations 2, and optionally trimmed 8 before solution heat-treating. The strip may be of a T4 or T43 temper. The temperature of the heating step and the subsequent quenching step will vary depending on the desired temper. In other embodiments, quenching may occur between any steps of the flow diagram, such as between casting 1 and shear and trim 2. In further embodiments, coiling may occur after rolling 6 followed by offline cold work or solution heat treatment. In other embodiments, the production method may utilize the casting step as the solutionizing step, and thus may be free of any solution heat treatment or anneal, as described in co-owned U.S. Patent Application Publication No. US2014/0000768, which is incorporated herein by reference in its entirety. In one embodiment, an aluminum alloy strip is coiled after the quenching. The coiled product (e.g., in the T4 or T43 temper) may be shipped to a customer (e.g. for use in producing formed automotive pieces/parts, such as formed automotive panels.) The customer may paint bake and/or otherwise thermally treat (e.g., artificially age) the formed product to achieve a final tempered product (e.g., in a T6 temper, which may be a near peak strength T6 temper, as described below).

As used herein, the term "anneal" refers to a heating process that causes recovery and/or recrystallization of the metal to occur (e.g., to improve formability). Typical temperatures used in annealing aluminum alloys range from 500 to 900° F.

Also as used herein, the term "solution heat treatment" refers to a metallurgical process in which the metal is held at a high temperature so as to cause second phase particles of the alloying elements to at least partially dissolve into solid solution (e.g. completely dissolve second phase particles). Temperatures used in solution heat treatment are generally higher than those used in annealing, but below the incipient melting point of the alloy, such as temperatures in the range of from 905° F. to up to 1060° F. In one embodiment, the solution heat treatment temperature is at least 950° F. In another embodiment, the solution heat treatment temperature is at least 960° F. In yet another embodiment, the solution heat treatment temperature is at least 970° F. In another embodiment, the solution heat treatment temperature is at least 980° F. In yet another embodiment, the solution heat treatment temperature is at least 990° F. In another embodiment, the solution heat treatment temperature is at least 1000° F. In one embodiment, the solution heat treatment temperature is not greater than least 1050° F. In another embodiment, the solution heat treatment temperature is not greater than least 1040° F. In another embodiment, the solution heat treatment temperature is not greater than least 1030° F. In one embodiment, solution heat treatment is at a temperature at least from 950° to 1060° F. In another embodiment, the solution heat treatment is at a temperature of from 960° to 1060° F. In yet another embodiment, the solution heat treatment is at a temperature of from 970° to 1050° F. In another embodiment, the solution heat treatment is at a temperature of from 980° to 1040° F. In yet another embodiment, the solution heat treatment is at a temperature of from 990° to 1040° F. In another embodiment, the solution heat treatment is at a temperature of from 1000° to 1040° F.

As used herein, the term "feedstock" refers to the aluminum alloy in strip form. The feedstock employed in the practice of the present invention can be prepared by any number of continuous casting techniques well known to those skilled in the art. A preferred method for making the strip is described in U.S. Pat. No. 5,496,423 issued to Wyatt-Mair and Harrington. Another preferred method is as described in application Ser. No. 10/078,638 (now U.S. Pat. No. 6,672,368) and Ser. No. 10/377,376, both of which are assigned to the assignee of the present invention. Typically, the cast strip will have a width of from about 43 to 254 cm (about 17 to 100 inches), depending on desired continued processing and the end use of the strip.

FIG. 2 shows schematically an apparatus for one of many alternative embodiments in which additional heating and rolling steps are carried out. Metal is heated in a furnace 80 and the molten metal is held in melter holders 81, 82. The molten metal is passed through troughing 84 and is further prepared by degassing 86 and filtering 88. The tundish 90 supplies the molten metal to the continuous caster 92, exemplified as a belt caster, although not limited to this. The metal feedstock 94 which emerges from the caster 92 is moved through optional shear 96 and trim 98 stations for edge trimming and transverse cutting, after which it is passed to an optional quenching station 100 for adjustment of rolling temperature.

After quenching 100, the feedstock 94 is passed through a rolling mill 102, from which it emerges at an intermediate thickness. The feedstock 94 is then subjected to additional hot milling (rolling) 104 and optionally cold milling (rolling) 106, 108 to reach the desired final gauge. Cold milling (rolling) may be performed in-line as shown or offline.

Any of a variety of quenching devices may be used in the practice of the present invention. Typically, the quenching station is one in which a cooling fluid, either in liquid or gaseous form is sprayed onto the hot feedstock to rapidly reduce its temperature. Suitable cooling fluids include water, air, liquefied gases such as carbon dioxide, and the like. It is preferred that the quench be carried out quickly to reduce the temperature of the hot feedstock rapidly to prevent substantial precipitation of alloying elements from solid solution.

In general, the quench at station 100 reduces the temperature of the feedstock as it emerges from the continuous caster from a temperature of 850 to 1050° F. to the desired rolling temperature (e.g. hot or cold rolling temperature). In general, the feedstock will exit the quench at station 100 with a temperature ranging from 100 to 950° F., depending on alloy and temper desired. Water sprays or an air quench may be used for this purpose. In another embodiment, quenching reduces the temperature of the feedstock from 900 to 950° F. to 800 to 850° F. In another embodiment, the feedstock will exit the quench at station 51 with a temperature ranging from 600 to 900° F.

Hot rolling 102 is typically carried out at temperatures within the range from 400 to 1000° F., preferably 400 to 900° F., more preferably 700 to 900° F. Cold rolling is typically carried out at temperatures from ambient temperature to less than 400° F. When hot rolling, the temperature of the strip at the exit of a hot rolling stand may be between 100 and 800° F., preferably 100 to 550° F., since the strip may be cooled by the rolls during rolling.

The extent of the reduction in thickness affected by the rolling steps, including at least two rolling stands of the present invention, is intended to reach the required finish gauge or intermediate gauge, either of which can be a target thickness. As shown in the below examples, using two rolling stands facilitates an unexpected and improved combination of properties. In one embodiment, the combination of the first rolling stand plus the at least second rolling stand reduces the as-cast (casting) thickness by from 15% to 80% to achieve a target thickness. The as-cast (casting) gauge of the strip may be adjusted so as to achieve the appropriate total reduction over the at least two rolling stands to achieve the target thickness. In another embodiment, the combination of the first rolling stand plus the at least second rolling stand may reduce the as-cast (casting) thickness by at least 25%. In yet another embodiment, the combination of the first rolling stand plus the at least second rolling stand may reduce the as-cast (casting) thickness by at least 30%. In another embodiment, the combination of the first rolling stand plus the at least second rolling stand may reduce the as-cast (casting) thickness by at least 35%. In yet another embodiment, the combination of the first rolling stand plus the at least second rolling stand may reduce the as-cast (casting) thickness by at least 40%. In any of these embodiments, the combination of the first hot rolling stand plus the at least second hot rolling stand may reduce the as-cast (casting) thickness by not greater than 75%. In any of these embodiments, the combination of the first hot rolling stand plus the at least second hot rolling stand may reduce the as-cast (casting) thickness by not greater than 65%. In any of these embodiments, the combination of the first hot rolling stand plus the at least second hot rolling stand may reduce the as-cast (casting) thickness by not greater than 60%. In any of these embodiments, the combination of the first hot rolling stand plus the at least second hot rolling stand may reduce the as-cast (casting) thickness by not greater than 55%.

In one approach, the combination of the first rolling stand plus the at least second rolling stand reduces the as-cast (casting) thickness by from 15% to 75% to achieve a target thickness. In one embodiment, the combination of the first rolling stand plus the at least second rolling stand reduces the as-cast (casting) thickness by from 15% to 70% to achieve a target thickness. In another embodiment, the combination of the first rolling stand plus the at least second rolling stand reduces the as-cast (casting) thickness by from 15% to 65% to achieve a target thickness. In yet another embodiment, the combination of the first rolling stand plus the at least second rolling stand reduces the as-cast (casting) thickness by from 15% to 60% to achieve a target thickness. In another embodiment, the combination of the first rolling stand plus the at least second rolling stand reduces the as-cast (casting) thickness by from 15% to 55% to achieve a target thickness.

In another approach, the combination of the first rolling stand plus the at least second rolling stand reduces the as-cast (casting) thickness by from 20% to 75% to achieve a target thickness. In one embodiment, the combination of the first rolling stand plus the at least second rolling stand reduces the as-cast (casting) thickness by from 20% to 70% to achieve a target thickness. In another embodiment, the combination of the first rolling stand plus the at least second rolling stand reduces the as-cast (casting) thickness by from 20% to 65% to achieve a target thickness. In yet another embodiment, the combination of the first rolling stand plus the at least second rolling stand reduces the as-cast (casting) thickness by from 20% to 60% to achieve a target thickness. In another embodiment, the combination of the first rolling stand plus the at least second rolling stand reduces the as-cast (casting) thickness by from 20% to 55% to achieve a target thickness.

In another approach, the combination of the first rolling stand plus the at least second rolling stand reduces the as-cast (casting) thickness by from 25% to 75% to achieve a target thickness. In one embodiment, the combination of the first rolling stand plus the at least second rolling stand reduces the as-cast (casting) thickness by from 25% to 70% to achieve a target thickness. In another embodiment, the combination of the first rolling stand plus the at least second rolling stand reduces the as-cast (casting) thickness by from 25% to 65% to achieve a target thickness. In yet another embodiment, the combination of the first rolling stand plus the at least second rolling stand reduces the as-cast (casting) thickness by from 25% to 60% to achieve a target thickness. In another embodiment, the combination of the first rolling stand plus the at least second rolling stand reduces the as-cast (casting) thickness by from 25% to 55% to achieve a target thickness.

In another approach, the combination of the first rolling stand plus the at least second rolling stand reduces the as-cast (casting) thickness by from 30% to 75% to achieve a target thickness. In one embodiment, the combination of the first rolling stand plus the at least second rolling stand reduces the as-cast (casting) thickness by from 30% to 70% to achieve a target thickness. In another embodiment, the combination of the first rolling stand plus the at least second rolling stand reduces the as-cast (casting) thickness by from 30% to 65% to achieve a target thickness. In yet another embodiment, the combination of the first rolling stand plus the at least second rolling stand reduces the as-cast (casting) thickness by from 30% to 60% to achieve a target thickness. In another embodiment, the combination of the first rolling stand plus the at least second rolling stand reduces the as-cast (casting) thickness by from 30% to 55% to achieve a target thickness.

In another approach, the combination of the first rolling stand plus the at least second rolling stand reduces the as-cast (casting) thickness by from 35% to 75% to achieve a target thickness. In one embodiment, the combination of the first rolling stand plus the at least second rolling stand reduces the as-cast (casting) thickness by from 35% to 70% to achieve a target thickness. In another embodiment, the combination of the first rolling stand plus the at least second rolling stand reduces the as-cast (casting) thickness by from 35% to 65% to achieve a target thickness. In yet another embodiment, the combination of the first rolling stand plus the at least second rolling stand reduces the as-cast (casting) thickness by from 35% to 60% to achieve a target thickness. In another embodiment, the combination of the first rolling stand plus the at least second rolling stand reduces the as-cast (casting) thickness by from 35% to 55% to achieve a target thickness.

In another approach, the combination of the first rolling stand plus the at least second rolling stand reduces the as-cast (casting) thickness by from 40% to 75% to achieve a target thickness. In one embodiment, the combination of the first rolling stand plus the at least second rolling stand reduces the as-cast (casting) thickness by from 40% to 70% to achieve a target thickness. In another embodiment, the combination of the first rolling stand plus the at least second rolling stand reduces the as-cast (casting) thickness by from 40% to 65% to achieve a target thickness. In yet another embodiment, the combination of the first rolling stand plus the at least second rolling stand reduces the as-cast (casting) thickness by from 40% to 60% to achieve a target thickness. In another embodiment, the combination of the first rolling stand plus the at least second rolling stand reduces the as-cast (casting) thickness by from 40% to 55% to achieve a target thickness.

Regarding the first rolling stand, in one embodiment, a thickness reduction of 1-50% is accomplished by the first rolling stand, the thickness reduction being from a casting thickness to an intermediate thickness. In one embodiment, the first rolling stand reduces the as-cast (casting) thickness by 5-45%. In another embodiment, the first rolling stand reduces the as-cast (casting) thickness by 10-45%. In yet another embodiment, the first rolling stand reduces the as-cast (casting) thickness by 11-40%. In another embodiment, the first rolling stand reduces the as-cast (casting) thickness by 12-35%. In yet another embodiment, the first rolling stand reduces the as-cast (casting) thickness by 12-34%. In another embodiment, the first rolling stand reduces the as-cast (casting) thickness by 13-33%. In yet another embodiment, the first rolling stand reduces the as-cast (casting) thickness by 14-32%. In another embodiment, the first rolling stand reduces the as-cast (casting) thickness by 15-31%. In yet another embodiment, the first rolling stand reduces the as-cast (casting) thickness by 16-30%. In another embodiment, the first rolling stand reduces the as-cast (casting) thickness by 17-29%.

The second rolling stand (or combination of second rolling stand plus any additional rolling stands) achieves a thickness reduction of 1-70% relative to the intermediate thickness achieved by the first rolling stand. Using math, the skilled person can select the appropriate second rolling stand (or combination of second rolling stand plus any additional rolling stands) reduction based on the total reduction required to achieve the target thickness, and the amount of reduction achieved by the first rolling stand.

$$\text{Target thickness}=\text{Cast-gauge thickness}*(\%\text{ reduction by the } 1^{st}\text{ stand})*(\%\text{ reduction by } 2^{nd}\text{ and any subsequent stand(s)}) \quad (1)$$

$$\text{Total reduction to achieve target thickness}=1^{st}\text{ stand reduction}+2^{nd}\text{(or more) stand reduction} \quad (2)$$

In one embodiment, the second rolling stand (or combination of second rolling stand plus any additional rolling stands) achieves a thickness reduction of 5-70% relative to the intermediate thickness achieved by the first rolling stand. In another embodiment, the second rolling stand (or combination of second rolling stand plus any additional rolling stands) achieves a thickness reduction of 10-70% relative to the intermediate thickness achieved by the first rolling stand. In yet another embodiment, the second rolling stand (or combination of second rolling stand plus any additional rolling stands) achieves a thickness reduction of 15-70% relative to the intermediate thickness achieved by the first rolling stand. In another embodiment, the second rolling stand (or combination of second rolling stand plus any additional rolling stands) achieves a thickness reduction of 20-70% relative to the intermediate thickness achieved by the first rolling stand. In yet another embodiment, the second rolling stand (or combination of second rolling stand plus any additional rolling stands) achieves a thickness reduction of 25-70% relative to the intermediate thickness achieved by the first rolling stand. In another embodiment, the second rolling stand (or combination of second rolling stand plus any additional rolling stands) achieves a thickness reduction of 30-70% relative to the intermediate thickness achieved by the first rolling stand. In yet another embodiment, the second rolling stand (or combination of second rolling stand plus any additional rolling stands) achieves a thickness reduction of 35-70% relative to the intermediate thickness achieved by the first rolling stand. In another embodiment, the second rolling stand (or combination of second rolling stand plus any additional rolling stands) achieves a thickness reduction of 40-70% relative to the intermediate thickness achieved by the first rolling stand.

The feedstock generally enters the first rolling station (sometimes referred to as "stand" herein) with a suitable rolling thickness (e.g., of from 1.524 to 10.160 mm (0.060 to 0.400 inch)). The final gauge thickness of the strip after the at least two rolling stands may be in the range of from 0.1524 to 4.064 mm (0.006 to 0.160 inch). In one embodiment, the final gauge thickness of the strip after the at least two rolling stands is in the range of from 0.8 to 3.0 mm (0.031 to 0.118 inch).

The heating carried out at the heater 112 is determined by the alloy and temper desired in the finished product. In one preferred embodiment, the feedstock will be solution heat-treated in-line, at the solution heat treatment temperatures described above. Heating is carried out at a temperature and for a time sufficient to ensure solutionizing of the alloy but without incipient melting of the aluminum alloy. Solution heat treating facilitates production of T tempers.

In another embodiment, annealing may be performed after rolling (e.g. hot rolling), before additional cold rolling to reach the final gauge. In this embodiment, the feed stock proceeds through rolling via at least two stands, annealing, cold rolling, optionally trimming, solution heat-treating in-line or offline, and quenching. Additional steps may include tension-leveling and coiling.

Similarly, the quenching at station 100 will depend upon the temper desired in the final product. For example, feedstock which has been solution heat-treated will be quenched, preferably air and/or water quenched, to 70 to 250° F., preferably to 100 to 200° F. and then coiled. In another embodiment, feedstock which has been solution heat-treated will be quenched, preferably air and/or water quenched to 70 to 250° F., preferably 70 to 180° F. and then coiled. Preferably, the quench at station 100 is a water quench or an air quench or a combined quench in which water is applied first to bring the temperature of the strip to just above the Leidenfrost temperature (about 550° F. for many aluminum alloys) and is continued by an air quench. This method will combine the rapid cooling advantage of water quench with the low stress quench of airjets that will provide a high quality surface in the product and will minimize distortion. For heat treated products, an exit temperature of about 250° F. or below is preferred.

Products that have been annealed may be quenched, preferably air- or water-quenched, to 110 to 720° F., and then coiled. It may be appreciated that annealing may be performed in-line as illustrated, or off-line through batch annealing.

Although the process of the invention is described thus far in one embodiment as having a single step of two-stand rolling (e.g. hot rolling and/or cold rolling) to reach a target thickness, other embodiments are contemplated, and any suitable number of hot and cold rolling stands may be used to reach the appropriate target thickness. For instance, the rolling mill arrangement for thin gauges could comprise a hot rolling step, followed by hot and/or cold rolling steps as needed.

The feedstock 94 is then optionally trimmed 110 and then solution heat-treated in heater 112. Following solution heat treatment in the heater 112, the feedstock 94 optionally passes through a profile gauge 113, and is optionally quenched at quenching station 114. The resulting strip is subjected to x-ray 116, 118 and surface inspection 120 and then optionally coiled. The solution heat treatment station may be placed after the final gauge is reached, followed by the quench station. Additional in-line anneal steps and quenches may be placed between rolling steps for intermediate anneal and for keeping solute in solution, as needed.

After the solution heat treating and quenching, the new 6xxx aluminum alloys may be naturally aged, e.g., to a T4 or T43 temper. In some embodiments, after the natural aging, a coiled new 6xxx aluminum alloy product is shipped to a customer for further processing.

After any natural aging, the new 6xxx aluminum alloys may be artificially aged to develop precipitation hardening precipitates. The artificial aging may include heating the new 6xxx aluminum alloys at one or more elevated temperatures (e.g., from 93.3° to 232.2° C. (200° to 450° F.)) for one or more periods of time (e.g., for several minutes to several hours). The artificial aging may include paint baking of the new 6xxx aluminum alloy (e.g., when the aluminum alloy is used in an automotive application). Artificial aging may optionally be performed prior to paint baking (e.g., after forming the new 6xxx aluminum alloy into an automotive component). Additional artificial aging after any paint bake may also be completed, as necessary/appropriate. In one embodiment, the final 6xxx aluminum alloy product is in a T6 temper, meaning the final 6xxx aluminum alloy product has been solution heat treated, quenched, and artificially aged. The artificial aging does not necessarily require aging to peak strength, but the artificial aging could be completed to achieve peak strength, or near peak-aged strength (near peak-aged means within 10% of peak strength).

Composition

Any suitable 6xxx aluminum alloys may be processed according to the new methods described herein. Some suitable 6xxx aluminum alloys include alloys 6101, 6101A, 6101B, 6201, 6201A, 6401, 6501, 6002, 6003, 6103, 6005, 6005A, 6005B, 6005C, 6105, 6205, 6305, 6006, 6106, 6206, 6306, 6008, 6009, 6010, 6110, 6110A, 6011, 6111, 6012, 6012A, 6013, 6113, 6014, 6015, 6016, 6016A, 6116, 6018, 6019, 6020, 6021, 6022, 6023, 6024, 6025, 6026, 6027, 6028, 6031, 6032, 6033, 6040, 6041, 6042, 6043, 6151, 6351, 6351A, 6451, 6951, 6053, 6055, 6056, 6156, 6060, 6160, 6260, 6360, 6460, 6460B, 6560, 6660, 6061, 6061A, 6261, 6361, 6162, 6262, 6262A, 6063, 6463, 6463A, 6763, 6963, 6064, 6064A, 6065, 6066, 6068, 6069, 6070, 6081, 6181, 6181A, 6082, 6082A, 6182, 6091, and 6092, as defined by the Aluminum Association document "International Alloy Designations and Chemical Composition Limits for Wrought Aluminum and Wrought Aluminum Alloys" (January 2015), which is incorporated herein by reference.

In one embodiment, the new 6xxx aluminum alloy is a high-silicon 6xxx alloy containing from 0.8 to 1.25 wt. % Si, from 0.2 to 0.6 wt. % Mg, from 0.5 to 1.15 wt. % Cu, from 0.01 to 0.20 wt. % manganese, and from 0.01 to 0.3 wt. % iron.

Silicon (Si) is included in the new high-silicon 6xxx aluminum alloys, and generally in the range of from 0.80 wt. % to 1.25 wt. % Si. In one embodiment, a new high-silicon 6xxx aluminum alloy includes from 1.00 wt. % to 1.25 wt. % Si. In another embodiment, a new high-silicon 6xxx aluminum alloy includes from 1.05 wt. % to 1.25 wt. % Si. In yet another embodiment, a new high-silicon 6xxx aluminum alloy includes from 1.05 wt. % to 1.20 wt. % Si. In another embodiment, a new high-silicon 6xxx aluminum alloy includes from 1.05 wt. % to 1.15 wt. % Si. In another embodiment, a new high-silicon 6xxx aluminum alloy includes from 1.08 wt. % to 1.18 wt. % Si.

Magnesium (Mg) is included in the new high-silicon 6xxx aluminum alloy, and generally in the range of from 0.20 wt. % to 0.60 wt. % Mg. In one embodiment, a new high-silicon 6xxx aluminum alloy includes from 0.20 wt. % to 0.45 wt. % Mg. In another embodiment, a new high-silicon 6xxx aluminum alloy includes from 0.25 wt. % to 0.40 wt. % Mg.

Copper (Cu) is included in the new high-silicon 6xxx aluminum alloy, and generally in the range of from 0.50 wt. % to 1.15 wt. % Cu. In one embodiment, a new high-silicon 6xxx aluminum alloy includes from 0.60 wt. % to 1.10 wt. % Cu. In another embodiment, a new high-silicon 6xxx aluminum alloy includes from 0.65 wt. % to 1.05 wt. % Cu. In yet another embodiment, a new high-silicon 6xxx aluminum alloy includes from 0.70 wt. % to 1.00 wt. % Cu. In another embodiment, a new high-silicon 6xxx aluminum alloy includes from 0.75 wt. % to 1.00 wt. % Cu. In yet another embodiment, a new high-silicon 6xxx aluminum alloy includes from 0.75 wt. % to 0.95 wt. % Cu. In another embodiment, a new high-silicon 6xxx aluminum alloy includes from 0.75 wt. % to 0.90 wt. % Cu. In yet another embodiment, a new high-silicon 6xxx aluminum alloy includes from 0.80 wt. % to 0.95 wt. % Cu. In another embodiment, a new high-silicon 6xxx aluminum alloy includes from 0.80 wt. % to 0.90 wt. % Cu.

Iron (Fe) is included in the new high-silicon 6xxx aluminum alloy, and generally in the range of from 0.01 wt. % to 0.30 wt. % Fe. In one embodiment, a new high-silicon 6xxx aluminum alloy includes from 0.01 wt. % to 0.25 wt. % Fe. In another embodiment, a new high-silicon 6xxx aluminum alloy includes from 0.01 wt. % to 0.20 wt. % Fe. In yet another embodiment, a new high-silicon 6xxx aluminum alloy includes from 0.07 wt. % to 0.185 wt. % Fe. In another embodiment, a new high-silicon 6xxx aluminum alloy includes from 0.09 wt. % to 0.17 wt. % Fe.

Manganese (Mn) is included in the new high-silicon 6xxx aluminum alloy, and generally in the range of from 0.01 wt. % to 0.20 wt. % Mn. In one embodiment, a new high-silicon 6xxx aluminum alloy includes at least 0.02 wt. % Mn. In another embodiment, a new high-silicon 6xxx aluminum alloy includes at least 0.04 wt. % Mn. In yet another embodiment, a new high-silicon 6xxx aluminum alloy includes at least 0.05 wt. % Mn. In another embodiment, a new high-silicon 6xxx aluminum alloy includes at least 0.06 wt. % Mn. In one embodiment, a new high-silicon 6xxx aluminum alloy includes not greater than 0.18 wt. % Mn. In another embodiment, a new high-silicon 6xxx aluminum alloy includes not greater than 0.16 wt. % Mn. In yet embodiment, a new high-silicon 6xxx aluminum alloy includes not greater than 0.14 wt. % Mn. In one embodiment, a new high-silicon 6xxx aluminum alloy includes from 0.02 wt. % to 0.08 wt. % Mn. In another embodiment, a new high-silicon 6xxx aluminum alloy includes from 0.04 wt. % to 0.18 wt. % Mn. In yet another embodiment, a new high-silicon 6xxx aluminum alloy includes from 0.05 wt. % to 0.16 wt. % Mn. In another embodiment, a new high-silicon 6xxx aluminum alloy includes from 0.05 wt. % to 0.14 wt. % Mn.

Titanium (Ti) may optionally be included in the new high-silicon 6xxx aluminum alloy, and in an amount of up to 0.30 wt. % Ti. In one embodiment, a new high-silicon 6xxx aluminum alloy includes at least 0.01 wt. % Ti. For embodiments where increased corrosion resistance is important, the new high-silicon 6xxx aluminum alloy includes at least 0.05 wt. % Ti. In one embodiment, a new high-silicon 6xxx aluminum alloy includes at least 0.06 wt. % Ti. In another embodiment, a new high-silicon 6xxx aluminum alloy includes at least 0.07 wt. % Ti. In yet another embodiment, a new high-silicon 6xxx aluminum alloy includes at least 0.08 wt. % Ti. In another embodiment, a new high-silicon 6xxx aluminum alloy includes at least 0.09 wt. % Ti. In yet another embodiment, a new high-silicon 6xxx aluminum alloy includes at least 0.10 wt. % Ti. In one embodiment, a new high-silicon 6xxx aluminum alloy includes not greater than 0.25 wt. % Ti. In another embodiment, a new high-silicon 6xxx aluminum alloy includes not greater than 0.21 wt. % Ti. In yet another embodiment, a new high-silicon 6xxx aluminum alloy includes not greater than 0.18 wt. % Ti. In another embodiment, a new high-silicon 6xxx aluminum alloy includes not greater than 0.15 wt. % Ti. In yet another embodiment, a new high-silicon 6xxx aluminum alloy includes not greater than 0.12 wt. % Ti. In one embodiment, a new high-silicon 6xxx aluminum alloy includes from 0.01 wt. % to 0.30 wt. % Ti. In another embodiment, a new high-silicon 6xxx aluminum alloy includes from 0.05 wt. % to 0.25 wt. % Ti. In yet another embodiment, a new high-silicon 6xxx aluminum alloy includes from 0.06 wt. % to 0.21 wt. % Ti. In another embodiment, a new high-silicon 6xxx aluminum alloy includes from 0.07 wt. % to 0.18 wt. % Ti. In yet another embodiment, a new high-silicon 6xxx aluminum alloy includes from 0.08 wt. % to 0.15 wt. % Ti. In another embodiment, a new high-silicon 6xxx aluminum alloy includes from 0.09 wt. % to 0.12 wt. % Ti. In another embodiment, a new high-silicon 6xxx aluminum alloy includes about 0.11 wt. % Ti. In some embodiments, the 6xxx high-silicon aluminum alloy may be free of titanium, or may include from 0.01 to 0.04 wt. % Ti.

Zinc (Zn) may optionally be included in the new high-silicon 6xxx aluminum alloy, and in an amount up to 0.25 wt. % Zn. In one embodiment, a new high-silicon 6xxx aluminum alloy includes up to 0.20 wt. % Zn. In another embodiment, a new high-silicon 6xxx aluminum alloy includes up to 0.15 wt. % Zn.

Chromium (Cr) may optionally be included in the new high-silicon 6xxx aluminum alloy, and in an amount up to 0.15 wt. % Cr. In one embodiment, a new high-silicon 6xxx aluminum alloy includes up to 0.10 wt. % Cr. In another embodiment, a new high-silicon 6xxx aluminum alloy includes up to 0.07 wt. % Cr. In yet another embodiment, a new high-silicon 6xxx aluminum alloy includes up to 0.05 wt. % Cr.

Zirconium (Zr) may optionally be included in the new high-silicon 6xxx aluminum alloy, and in an amount up to 0.18 wt. % Zr. In one embodiment, a new high-silicon 6xxx aluminum alloy includes up to 0.14 wt. % Zr. In another embodiment, a new high-silicon 6xxx aluminum alloy includes up to 0.11 wt. % Zr. In yet another embodiment, a new high-silicon 6xxx aluminum alloy includes up to 0.08 wt. % Zr. In another embodiment, a new high-silicon 6xxx aluminum alloy includes up to 0.05 wt. % Zr.

As noted above, the balance of the new high-silicon 6xxx aluminum alloy is aluminum and other elements. As used herein, "other elements" includes any other metallic elements of the periodic table other than the above-identified elements, i.e., any elements other than aluminum (Al), Ti, Si, Mg, Cu, Fe, Mn, Zn, Cr, and Zr. The new high-silicon 6xxx aluminum alloy may include not more than 0.10 wt. % each of any other element, with the total combined amount of these other elements not exceeding 0.30 wt. % in the new aluminum alloy. In one embodiment, each one of these other elements, individually, does not exceed 0.05 wt. % in the aluminum alloy, and the total combined amount of these other elements does not exceed 0.15 wt. % in the aluminum alloy. In another embodiment, each one of these other elements, individually, does not exceed 0.03 wt. % in the aluminum alloy, and the total combined amount of these other elements does not exceed 0.10 wt. % in the aluminum alloy.

Except where stated otherwise, the expression "up to" when referring to the amount of an element means that that elemental composition is optional and includes a zero amount of that particular compositional component. Unless stated otherwise, all compositional percentages are in weight percent (wt. %). The below table provides some non-limiting embodiments of new high-silicon 6xxx aluminum alloys.

Embodiments of the new high-silicon 6*xxx* aluminum alloys
(all values in weight percent)

| Embodiment | Si | Mg | Cu | Fe | Mn | Ti |
|---|---|---|---|---|---|---|
| 1 | 0.80-1.25 | 0.20-0.60 | 0.50-1.15 | 0.01-0.30 | 0.01-0.20 | 0.01-0.30 |
| 2 | 1.00-1.25 | 0.20-0.45 | 0.65-1.05 | 0.01-0.25 | 0.02-0.18 | 0.05-0.25 |
| 3 | 1.05-1.25 | 0.20-0.45 | 0.75-1.00 | 0.01-0.20 | 0.04-0.18 | 0.06-0.21 |

-continued

| | | | | | | |
|---|---|---|---|---|---|---|
| 4 | 1.05-1.15 | 0.25-0.40 | 0.75-0.95 | 0.07-0.185 | 0.05-0.16 | 0.07-0.18 |
| 5 | 1.08-1.18 | 0.25-0.40 | 0.80-0.90 | 0.09-0.17 | 0.05-0.14 | 0.08-0.15 |
| Embodiment | Zn | Cr | Zr | Others, each | Others, total | Bal. |
| 1 | ≤0.25 | ≤0.15 | ≤0.18 | ≤0.10 | ≤0.35 | Al |
| 2 | ≤0.20 | ≤0.10 | ≤0.14 | ≤0.05 | ≤0.15 | Al |
| 3 | ≤0.20 | ≤0.07 | ≤0.11 | ≤0.05 | ≤0.15 | Al |
| 4 | ≤0.15 | ≤0.05 | ≤0.08 | ≤0.03 | ≤0.10 | Al |
| 5 | ≤0.15 | ≤0.05 | ≤0.05 | ≤0.03 | ≤0.10 | Al |

Properties

As mentioned above, the new 6xxx aluminum alloys may realize an improved combination of properties. In one embodiment, the improved combination of properties relates to an improved combination of strength and formability. In one embodiment, the improved combination of properties relates to an improved combination of strength, formability and corrosion resistance.

The 6xxx aluminum alloy product may realize, in a naturally aged condition, a tensile yield strength (LT) of from 100 to 200 MPa when measured in accordance with ASTM B557. For instance, after solution heat treatment, optional stress relief (e.g., 1-6% stretch), and natural aging, the 6xxx aluminum alloy product may realize a tensile yield strength (LT) of from 100 to 200 MPa, such as in one of the T4 or T43 temper. The naturally aged strength in the T4 or T43 temper is to be measured at 30 days of natural aging.

In one embodiment, a new 6xxx aluminum alloy in the T4 temper may realize a tensile yield strength (LT) of at least 130 MPa. In another embodiment, a new 6xxx aluminum alloy in the T4 temper may realize a tensile yield strength (LT) of at least 135 MPa. In yet another embodiment, a new 6xxx aluminum alloy in the T4 temper may realize a tensile yield strength (LT) of at least 140 MPa. In another embodiment, a new 6xxx aluminum alloy in the T4 temper may realize a tensile yield strength (LT) of at least 145 MPa. In yet another embodiment, a new 6xxx aluminum alloy in the T4 temper may realize a tensile yield strength (LT) of at least 150 MPa. In another embodiment, a new 6xxx aluminum alloy in the T4 temper may realize a tensile yield strength (LT) of at least 155 MPa. In yet another embodiment, a new 6xxx aluminum alloy in the T4 temper may realize a tensile yield strength (LT) of at least 160 MPa. In another embodiment, a new 6xxx aluminum alloy in the T4 temper may realize a tensile yield strength (LT) of at least 165 MPa. In yet another embodiment, a new 6xxx aluminum alloy in the T4 temper may realize a tensile yield strength (LT) of at least 170 MPa.

In one embodiment, a new 6xxx aluminum alloy in the T43 temper may realize a tensile yield strength (LT) of at least 110 MPa. In another embodiment, a new 6xxx aluminum alloy in the T43 temper may realize a tensile yield strength (LT) of at least 115 MPa. In yet another embodiment, a new 6xxx aluminum alloy in the T43 temper may realize a tensile yield strength (LT) of at least 120 MPa. In another embodiment, a new 6xxx aluminum alloy in the T43 temper may realize a tensile yield strength (LT) of at least 125 MPa. In yet another embodiment, a new 6xxx aluminum alloy in the T43 temper may realize a tensile yield strength (LT) of at least 130 MPa. In another embodiment, a new 6xxx aluminum alloy in the T43 temper may realize a tensile yield strength (LT) of at least 135 MPa. In yet another embodiment, a new 6xxx aluminum alloy in the T43 temper may realize a tensile yield strength (LT) of at least 140 MPa. In another embodiment, a new 6xxx aluminum alloy in the T43 temper may realize a tensile yield strength (LT) of at least 145 MPa. In yet another embodiment, a new 6xxx aluminum alloy in the T43 temper may realize a tensile yield strength (LT) of at least 150 MPa.

The 6xxx aluminum alloy product may realize, in an artificially aged condition, a tensile yield strength (LT) of from 160 to 350 MPa when measured in accordance with ASTM B557. For instance, after solution heat treatment, optional stress relief (e.g., 1-6% stretch), and artificial aging, a new 6xxx aluminum alloy product may realized a near peak strength of from 160 to 350 MPa. In one embodiment, new 6xxx aluminum alloys may realize a tensile yield strength (LT) of at least 165 MPa (e.g., when aged to near peak strength). In another embodiment, new 6xxx aluminum alloys may realize a tensile yield strength (LT) of at least 170 MPa. In yet another embodiment, new 6xxx aluminum alloys may realize a tensile yield strength (LT) of at least 175 MPa. In another embodiment, new 6xxx aluminum alloys may realize a tensile yield strength (LT) of at least 180 MPa. In yet another embodiment, new 6xxx aluminum alloys may realize a tensile yield strength (LT) of at least 185 MPa. In another embodiment, new 6xxx aluminum alloys may realize a tensile yield strength (LT) of at least 190 MPa. In yet another embodiment, new 6xxx aluminum alloys may realize a tensile yield strength (LT) of at least 195 MPa. In another embodiment, new 6xxx aluminum alloys may realize a tensile yield strength (LT) of at least 200 MPa. In yet another embodiment, new 6xxx aluminum alloys may realize a tensile yield strength (LT) of at least 205 MPa. In another embodiment, new 6xxx aluminum alloys may realize a tensile yield strength (LT) of at least 210 MPa. In yet another embodiment, new 6xxx aluminum alloys may realize a tensile yield strength (LT) of at least 215 MPa. In another embodiment, new 6xxx aluminum alloys may realize a tensile yield strength (LT) of at least 220 MPa. In yet another embodiment, new 6xxx aluminum alloys may realize a tensile yield strength (LT) of at least 225 MPa, or more.

In one embodiment, the new 6xxx aluminum alloys realize an $FLD_o$ of from 28.0 to 35.0 (Engr %) at a gauge of 1.0 mm when measured in accordance with ISO 12004-2: 2008 standard, wherein the ISO standard is modified such that fractures more than 15% of the punch diameter away from the apex of the dome are counted as valid. In one embodiment, the new 6xxx aluminum alloys realize an $FLD_o$ of at least 28.5 (Engr %). In another embodiment, the new 6xxx aluminum alloys realize an $FLD_o$ of at least 29.0 (Engr %). In yet another embodiment, the new 6xxx aluminum alloys realize an $FLD_o$ of at least 29.5 (Engr %). In another embodiment, the new 6xxx aluminum alloys realize an $FLD_o$ of at least 30.0 (Engr %). In yet another embodiment, the new 6xxx aluminum alloys realize an $FLD_o$ of at least 30.5 (Engr %). In another embodiment, the new 6xxx aluminum alloys realize an $FLD_o$ of at least 31.0 (Engr %). In yet another embodiment, the new 6xxx aluminum alloys realize an $FLD_o$ of at least 31.5 (Engr %). In another embodiment, the new 6xxx aluminum alloys realize an $FLD_o$ of at least 32.0 (Engr %). In yet another embodiment, the new 6xxx aluminum alloys realize an $FLD_o$ of at least 32.5 (Engr %). In another embodiment, the new 6xxx aluminum alloys realize an $FLD_o$ of at least 33.0 (Engr %). In yet another embodiment, the new 6xxx aluminum alloys realize an $FLD_o$ of at least 33.5 (Engr %). In another embodiment, the new 6xxx aluminum alloys realize an $FLD_o$ of at least 33.0 (Engr %). In yet another embodiment, the new 6xxx aluminum alloys realize an $FLD_o$ of at least 34.5 (Engr %), or more.

The new 6xxx aluminum alloys may realize good intergranular corrosion resistance when tested in accordance with ISO standard 11846(1995) (Method B), such as realizing a depth of attack measurement of not greater than 350 microns (e.g., in the near peak-aged, as defined above, condition). In one embodiment, the new 6xxx aluminum alloys may realize a depth of attack of not greater than 340 microns. In another embodiment, the new 6xxx aluminum alloys may realize a depth of attack of not greater than 330 microns. In yet another embodiment, the new 6xxx aluminum alloys may realize a depth of attack of not greater than 320 microns. In another embodiment, the new 6xxx aluminum alloys may realize a depth of attack of not greater than 310 microns. In yet another embodiment, the new 6xxx aluminum alloys may realize a depth of attack of not greater than 300 microns. In another embodiment, the new 6xxx aluminum alloys may realize a depth of attack of not greater than 290 microns. In yet another embodiment, the new 6xxx aluminum alloys may realize a depth of attack of not greater than 280 microns. In another embodiment, the new 6xxx aluminum alloys may realize a depth of attack of not greater than 270 microns. In yet another embodiment, the new 6xxx aluminum alloys may realize a depth of attack of not greater than 260 microns. In another embodiment, the new 6xxx aluminum alloys may realize a depth of attack of not greater than 250 microns. In yet another embodiment, the new 6xxx aluminum alloys may realize a depth of attack of not greater than 240 microns. In another embodiment, the new 6xxx aluminum alloys may realize a depth of attack of not greater than 230 microns, or less.

As noted above, the new 6xxx aluminum alloys may realize an improved combination of properties. The improved combination of properties may be due to the unique microstructure of the new 6xxx aluminum alloys. For instance, the new 6xxx aluminum alloys may include an improved dispersion of second phase particles. "Second phase particles" are constituent particles containing iron, copper, manganese, silicon, and/or chromium, for instance (e.g., $Al_{12}[Fe,Mn,Cr]_3Si$; $Al_9Fe_2Si_2$). Agglomeration/bunching of these second phase particles into clusters has been found to be detrimental to the properties of the alloy, such as formability. The number of second phase particle clusters can be determined using image analysis techniques. The number density of these second phase particle clusters can then be determined. A large cluster number density indicates that the second phase particles are less agglomerated in the alloy, which may be beneficial to formability and/or strength. Thus, in some embodiments relating to the 6xxx aluminum alloys described herein, the 6xxx aluminum alloys realize an average second phase particle cluster number density of at least 4300 clusters per $mm^2$. The "average second phase particle clusters density" is determined according to the Second Phase Particle Cluster Number Density Measurement Procedure, described below. In one embodiment, the 6xxx aluminum alloys realize an average second phase particle cluster number density of at least 4400 clusters per $mm^2$. In another embodiment, the 6xxx aluminum alloys realize an average second phase particle cluster number density of at least 4500 clusters per $mm^2$. In yet another embodiment, the 6AAS realizes an average second phase particle cluster number density of at least 4600 clusters per $mm^2$. In another embodiment, the 6AAS realizes an average second phase particle cluster number density of at least 4700 clusters per $mm^2$. In yet another embodiment, the 6AAS realizes an average second phase particle cluster number density of at least 4800 clusters per $mm^2$. In another embodiment, the 6AAS realizes an average second phase particle cluster number density of at least 4900 clusters per $mm^2$. In yet another embodiment, the 6AAS realizes an average second phase particle cluster number density of at least 5000 clusters per $mm^2$. In another embodiment, the 6xxx aluminum alloys realize an average second phase particle cluster number density of at least 5100 clusters per $mm^2$. In yet another embodiment, the 6xxx aluminum alloys realize an average second phase particle cluster number density of at least 5200 clusters per $mm^2$. In another embodiment, the 6xxx aluminum alloys realize an average second phase particle cluster number density of at least 5300 clusters per $mm^2$. In yet another embodiment, the 6xxx aluminum alloys realize an average second phase particle cluster number density of at least 5400 clusters per $mm^2$. In another embodiment, the 6xxx aluminum alloys realize an average second phase particle cluster number density of at least 5500 clusters per $mm^2$. In yet another embodiment, the 6xxx aluminum alloys realize an average second phase particle cluster number density of at least 5600 clusters per $mm^2$. In another embodiment, the 6xxx aluminum alloys realize an average second phase particle cluster number density of at least 5700 clusters per $mm^2$. In yet another embodiment, the 6xxx aluminum alloys realize an average second phase particle cluster number density of at least 5800 clusters per $mm^2$. In another embodiment, the 6xxx aluminum alloys realize an average second phase particle cluster number density of at least 5900 clusters per $mm^2$. In yet another embodiment, the 6xxx aluminum alloys realize an average second phase particle cluster number density of at least 6000 clusters per $mm^2$. In another embodiment, the 6xxx aluminum alloys realize an average second phase particle cluster number density of at least 6100 clusters per $mm^2$. In yet another embodiment, the 6xxx aluminum alloys realize an average second phase particle cluster number density of at least 6200 clusters per $mm^2$. In another embodiment, the 6xxx aluminum alloys realize an average second phase particle cluster number density of at least 6300 clusters per $mm^2$. In yet another embodiment, the 6xxx aluminum alloys realize an average second phase particle cluster number density of at least 6400 clusters per $mm^2$. In another embodiment, the 6xxx aluminum alloys realize an average second phase particle cluster number density of at least 6500 clusters per $mm^2$. In yet another embodiment, the 6xxx aluminum alloys realize an average second phase particle cluster number density of at least 6600 clusters per $mm^2$. In another embodiment, the 6xxx aluminum alloys realize an average second phase particle cluster number density of at least 6700 clusters per $mm^2$. In yet another embodiment, the 6xxx aluminum alloys realize an average second phase particle cluster number density of at least 6800 clusters per $mm^2$. In another embodiment, the 6xxx aluminum alloys realize an average second phase particle cluster number density of at least 6900 clusters per $mm^2$. In yet another embodiment, the 6xxx aluminum alloys realize an average second phase particle cluster number density of at least 7000 clusters per $mm^2$. In another embodiment, the 6xxx aluminum alloys realize an average second phase particle cluster number density of at least 7100 clusters per $mm^2$. In yet another embodiment, the 6xxx aluminum alloys realize an average second phase particle cluster number density of at least 7200 clusters per $mm^2$. In another embodiment, the 6xxx aluminum alloys realize an average second phase particle cluster number density of at least 7300 clusters per $mm^2$. In yet another embodiment, the 6xxx aluminum alloys realize an average second phase particle cluster number density of at least 7400 clusters per $mm^2$. In another embodiment, the 6xxx aluminum alloys realize an average second phase particle cluster number density of at least 7500 clusters per $mm^2$. In yet another embodiment, the 6xxx aluminum alloys realize an average second phase particle cluster number density of at least 7600 clusters per $mm^2$. In another embodiment, the 6xxx aluminum alloys realize an average second phase particle cluster number density of at least 7700 clusters per $mm^2$. In yet another embodiment, the 6xxx aluminum alloys realize an average second phase particle cluster number density of at least 7800 clusters per $mm^2$. In another embodiment, the 6xxx aluminum alloys realize an average second phase particle cluster number density of at least 7900 clusters per $mm^2$.

Second Phase Particle Cluster Number Density Measurement Procedure

1. Preparation of Alloy for SEM Imaging

Longitudinal (L-ST) samples of the alloy are to be ground (e.g. for about 30 seconds) using progressively finer grit paper starting at 240 grit and moving through 320, 400, and finally to 600 grit paper. After grinding, the samples are to be polished (e.g., for about 2-3 minutes) on cloths using a sequence of (a) 3 micron mol cloth and 3 micron diamond suspension, (b) 3 micron silk cloth and 3 micron diamond suspension, and finally (c) a 1 micron silk cloth and 1 micron diamond suspension. During polishing, an appropriate oil-based lubricant may be used. A final polish prior to SEM examination is to be made using 0.05 micron colloidal silica (e.g., for about 30 seconds), with a final rinse under water.

2. SEM Image Collection 20 backscattered electron images are to be captured at the surface of the metallographically prepared (per section 1, above) longitudinal (L-ST) sections using a JSM Sirion XL30 FEG SEM, or comparable FEG SEM. The image size must be 1296 pixels by 968 pixels at a magnification of 500×. The pixel dimensions are x=0,195313 μm, y=0.19084 μm. The accelerating voltage is to be 5 kV at a working distance of 5.0 mm and spot size of 5. The contrast is to be set to 97 and the brightness is to be set to 56. The image collection should yield 8-bit digital grey level images (0 being black, 255 being white) with a matrix having an average grey level of about 55 with and a standard deviation of about +/−7.

3. Discrimination of Second Phase Particles

The average atomic number of the second phase particles of interest is greater than the matrix (the aluminum matrix) so the second phase particles will appear bright in the image representations. The pixels that make up the particles are defined as any pixel that has a grey level greater than (>) the average matrix grey level +5 standard deviations (e.g., using the numbers above 55+5*7=90). The average matrix grey level and standard deviation are calculated for each image. The pixel dimensions are x=0.195313 μm, y=0.19084 μm. A binary image is created by discriminating the grey level image to make all pixels higher than the average matrix grey level+5 standard deviations (the threshold) to be white (255) and all pixels at or lower than the threshold (the average matrix grey level+5 standard deviations) to be black (0).

4. Scrapping of Single White Pixels

Any individual white pixel that is not adjacent to another in one of eight directions is removed from the binary image.

5. Dilation Sequence

The white pixels in each binary image are to be dilated using the three structure elements shown in FIG. 6. The first structure element is applied to the original binary image for a single dilation (new image A), the second structure element is then applied to the original binary image for a single dilation (new image B), and the third structure element is applied to the original binary image for three dilations (new image C). New images A-C are then summed with any pixel in the summed image set to 255 if any corresponding pixel in the three images has a grey level of 255. This summed image becomes the "Final Image". The process described above is repeated using the "Final image" as the starting image, and repeated for a total of five dilation sequences. After the final sequence of dilations has been completed, the areas in the resultant image that have a grey level of 255 are measured as the clusters.

7. Cluster Measurement

The areas in the resultant image that have a grey level of 255 are counted as the clusters. Only objects that are totally within the measurement frame (not touching the image edges) are counted. The number of clusters in each image is counted and then divided by the image area to give cluster number density for that image. The median cluster number density for the 20 images is then calculated from the cluster number densities of the 20 images. The alloy sample is then subject to re-grinding with 600 grit paper and then re-polishing per step 1, after which steps 2-7 are then repeated to obtain a second median cluster number density. The median cluster number density from the first specimen and the second specimen are then averaged to give an average second phase particle cluster number density for the alloy.

End of the Second Phase Particle Cluster Number Density Measurement Procedure

The new 6xxx aluminum alloy strip products described herein may find use in a variety of product applications. In one embodiment, a new 6xxx aluminum alloy product made by the new processes described herein is used in an automotive application, such as closure panels (e.g., hoods, fenders, doors, roofs, and trunk lids, among others), and body-in-white (e.g., pillars, reinforcements) applications, among others.

DETAILED DESCRIPTION

Examples

Figure 1:
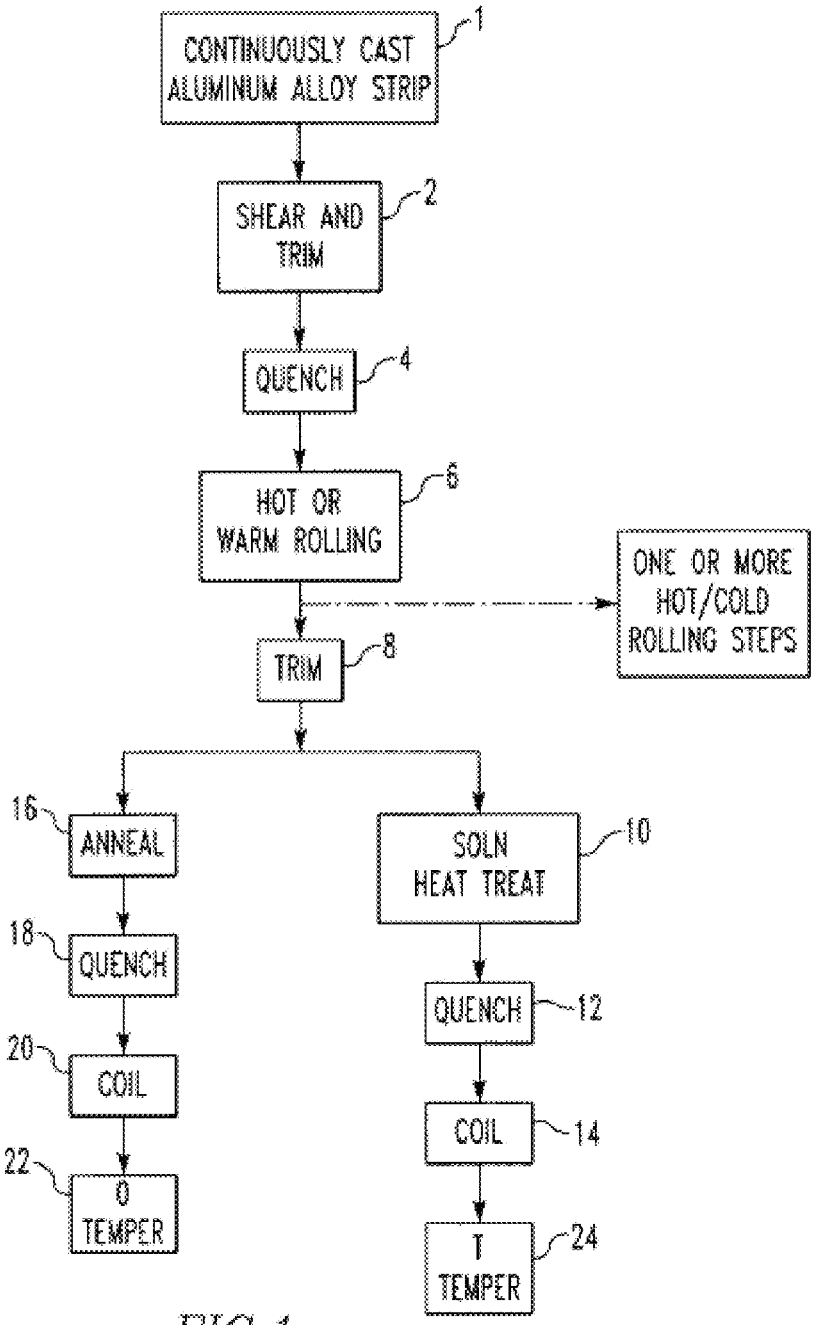
FIG. 1 is a flow chart illustrating one embodiment of processing steps of the present invention.
Figure 2:
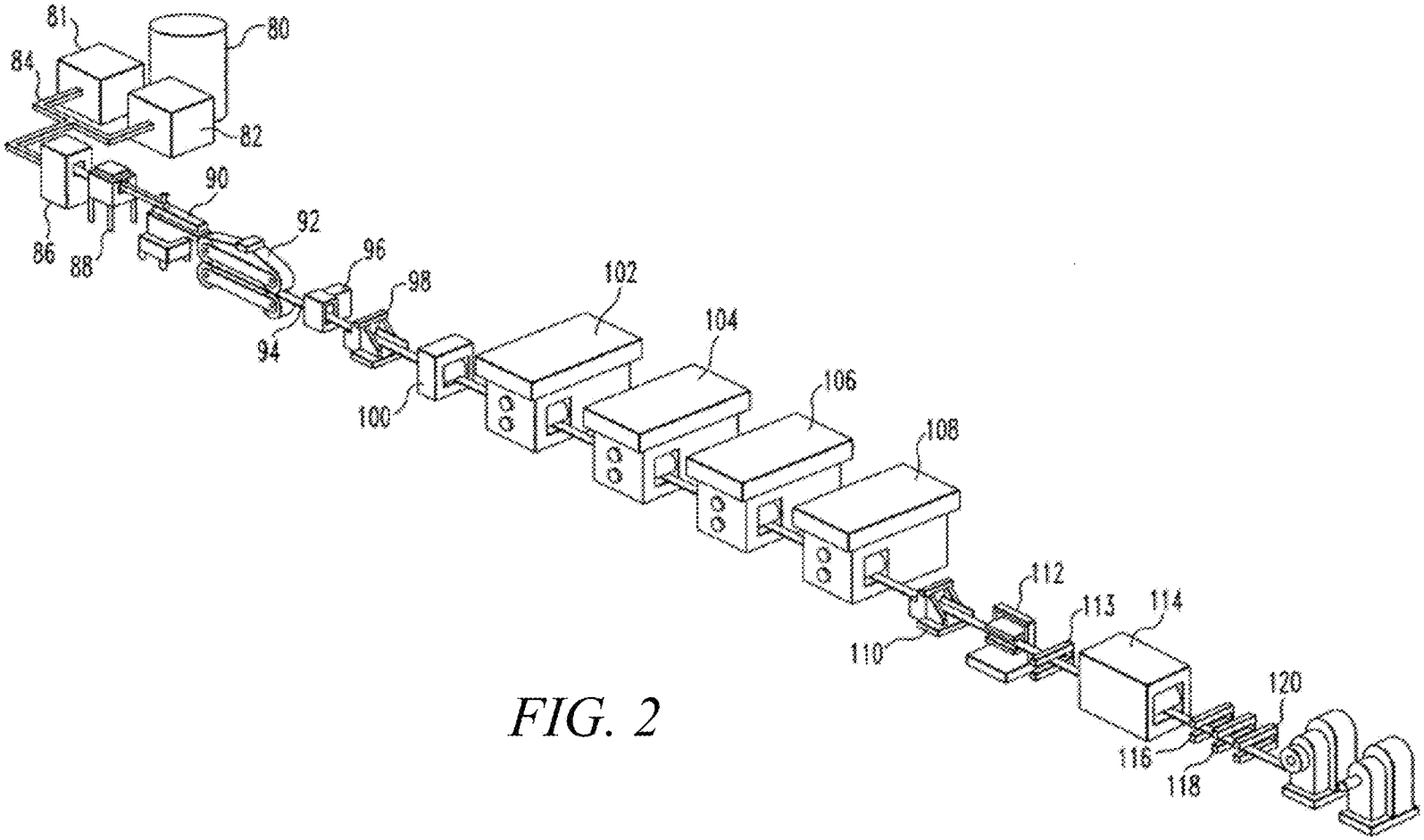
FIG. 2 is an additional embodiment of the apparatus used in carrying out the method of the present invention. This line is equipped with four rolling mills to reach a finer finished gauge.

The following examples are intended to illustrate the invention and should not be construed as limiting the invention in any way.

Example 1

Heat-treatable 6xxx aluminum alloys were processed in-line by the method of the present invention and a conventional method. The analysis of the melts was as follows:

TABLE 1

| Element Percentage by Weight | | | | | | | |
|---|---|---|---|---|---|---|---|
| Material | Si | Fe | Cu | Mn | Mg | Cr | Ti |
| Alloy A1 | 1.30 | 0.13 | 1.15 | 0.05 | 0.27 | 0.001 | 0.043 |
| Alloy A2 | 1.30 | 0.13 | 0.88 | 0.05 | 0.22 | 0.001 | 0.035 |
| Alloy A2N | 1.30 | 0.13 | 0.88 | 0.05 | 0.22 | 0.001 | 0.035 |
| Alloy A3 | 1.09 | 0.12 | 0.88 | 0.05 | 0.27 | 0.002 | 0.038 |
| Alloy A4 | 1.27 | 0.13 | 0.86 | 0.08 | 0.13 | 0.002 | 0.034 |

The balance of the alloys was aluminum and unavoidable impurities.

The alloys were continuously cast to a thickness of from 3.683 to 3.759 mm (0.145 to 0.148 inch) and processed in line by hot rolling in one step to an intermediate gauge of from 2.057 to 2.261 mm (0.081 to 0.089 inch) followed by water quenching (except that Alloy A2N was air cooled), then cold rolled to a finish gauge of 1.0 mm (about 0.039 inch). These samples were then processed to a T43 temper. The performance of the samples was then evaluated by measuring $FLD_o$ (measured in Engr %) and tensile yield strength (TYS) in the LT direction (measured in MPa) per ASTM B557. $FLD_o$ values were tested in accordance with ISO 12004-2:2008 specification, with the exception that fractures more than 15% of the punch diameter away from the apex of the dome were counted as valid. The TYS was tested after the samples were subjected to a simulated auto paint bake cycle ("paint bake" or "PB"). Specifically, response to a paint bake cycle was evaluated by imparting a 2% prestretch and then soaking the samples at about 338° F. for about 20 minutes (2% PS+338° F./20 min.); the 20 minutes at 338° F. is the soak and does not include the temperature ramp-up or ramp-down period. Examples of the test results are summarized below in Table 2. "1st Std HR Red (%)" provides the percent reduction of the thickness of the alloys through the first hot rolling stand. "Post HR Cooling" provides the type of cooling performed after hot rolling. "Ga (mm)" provides the finish gauge. "SHT Quench" provides the type of quenching used in solution heat treating.

TABLE 2

| Example 1 Parameters and Properties | | | | | | | |
|---|---|---|---|---|---|---|---|
| Material | 1st Std HR Red (%) | Post HR Cooling | Ga (mm) | SHT Quench | Temper | $FLD_o$ [T43] (Engr %) | TYS, LT [T43 + PB] (MPa) |
| A1 | 43 | Water Quench | 1.0 | Air | T43 | 26.4 | 177 |
| A2 | 40 | Water Quench | 1.0 | Air | T43 | 26.3 | 156 |

TABLE 2-continued

| Example 1 Parameters and Properties | | | | | | | |
|---|---|---|---|---|---|---|---|
| Material | 1st Std HR Red (%) | Post HR Cooling | Ga (mm) | SHT Quench | Temper | $FLD_o$ [T43] (Engr %) | TYS, LT [T43 + PB] (MPa) |
| A2N | 40 | Air Cooled | 1.0 | Air | T43 | 26.2 | 155 |
| A3 | 40 | Water Quench | 1.0 | Air | T43 | 27.6 | 165 |
| A4 | 44 | Water Quench | 1.0 | Air | T43 | 27.8 | 121 |

Figure 3:
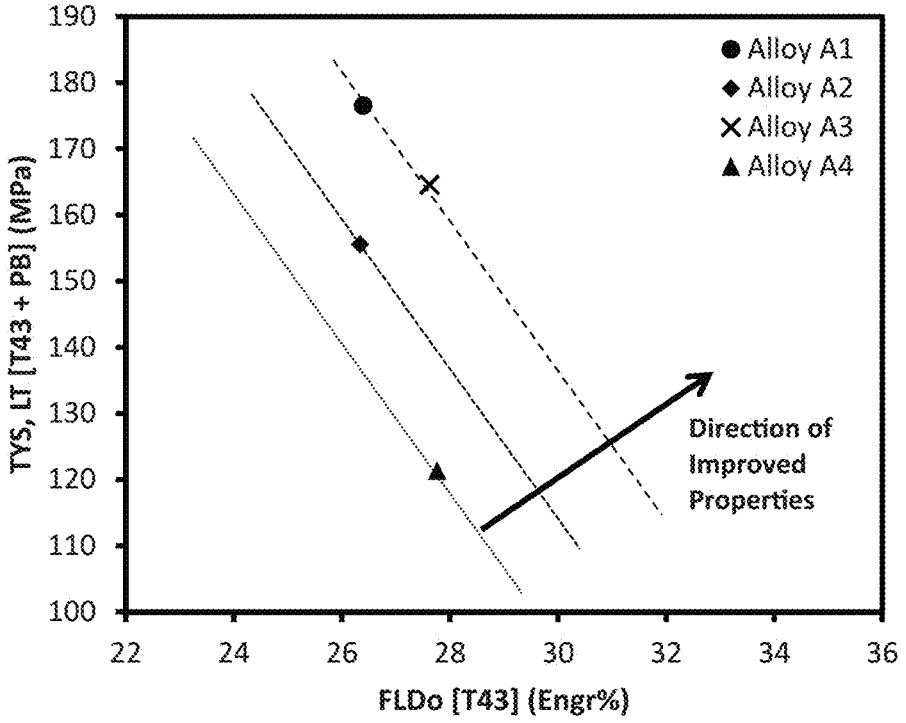
FIG. 3 is a graph showing properties for the Example 1 alloys.

The data of Table 2 is also presented in FIG. 3. The properties of Alloy A2N are not presented in FIG. 3 as they substantially overlap with the properties of Alloy A2.

Example 2

Heat-treatable aluminum alloys were processed in-line by the method of the present invention and a conventional method. The analysis of the melts was as follows:

TABLE 3

| Element Percentage by Weight | | | | | | | |
|---|---|---|---|---|---|---|---|
| Alloy | Si | Fe | Cu | Mn | Mg | Cr | Ti |
| B1 | 1.17 | 0.12 | 0.87 | 0.05 | 0.29 | 0.023 | 0.025 |
| B2 | 1.09 | 0.12 | 0.88 | 0.05 | 0.27 | 0.002 | 0.038 |
| B3 | 1.19 | 0.12 | 0.89 | 0.03 | 0.31 | 0.025 | 0.020 |
| B4 | 1.13 | 0.17 | 0.84 | 0.05 | 0.33 | 0.025 | 0.016 |

The balance of the alloys was aluminum and unavoidable impurities.

Alloys B1 and B3 were produced by direct chill casting and conventionally processed. Alloy B1 was processed to achieve a T43 temper, and alloy B3 was processed to achieve a T4 temper. Alloys B2 and B4 were produced by continuous casting at a thickness of from 3.759 to 4.978 mm (0.148 to 0.196 inch) and processed in line by hot and cold rolling. Alloy B2 was rolled using only one hot rolling stand whereas Alloy B4 used one hot rolling stand and one cold rolling stand. After rolling, alloy B2 was water quenched. Alloy B4 was water quenched between the hot rolling stand and the cold rolling stand. Alloy B2 was processed to achieve a T43 temper and Alloy B4 was processed to achieve a T4 temper. The performance of the samples was then evaluated by measuring $FLD_o$ (measured in Engr %), and tensile yield strength (TYS) in the LT direction (measured in MPa) per ASTM B557. $FLD_o$ values were tested in accordance with ISO 12004-2:2008 specification, with the exception that fractures more than 15% of the punch diameter away from the apex of the dome were counted as valid. The TYS was tested after the samples were subjected to a simulated auto paint bake cycle ("paint bake" or "PB") by soaking 2% prestretched samples at about 338° F. for about 20 minutes (2% PS+338° F./20 min.), as per Example 1. Examples of the test results are summarized below in Table 4. "1st Std FIR Red (%)" provides the percent reduction of the thickness of the alloys through the first hot rolling stand. "Post HR Cooling" provides the type of cooling performed after hot rolling at the first stand. "Gauge (mm)" provides the finish gauge. "SHT Quench" provides the type of quenching used in solution heat treating.

TABLE 4

Example 2 Parameters and Properties

| Alloy | 1st Std HR Red. (%) | Post HR Cooling | Gauge (mm) | SHT Quench | Temper | $FLD_o$ [T4 or T43] (Engr %) | TYS, LT [T4 or T43, + PB] (MPa) |
|---|---|---|---|---|---|---|---|
| B1 | N/A | N/A | 1.0 | Air | T43 | 26.4 | 160.7 |
| B2 | 40 | Water Quench | 1.0 | Air | T43 | 27.6 | 165 |
| B3 | N/A | N/A | 1.5 | Water | T4 | 29.4 | 162.1 |
| B4 | 17 | Water Quench | 1.5 | Water | T4 | 33.6 | 186 |

Figure 4:
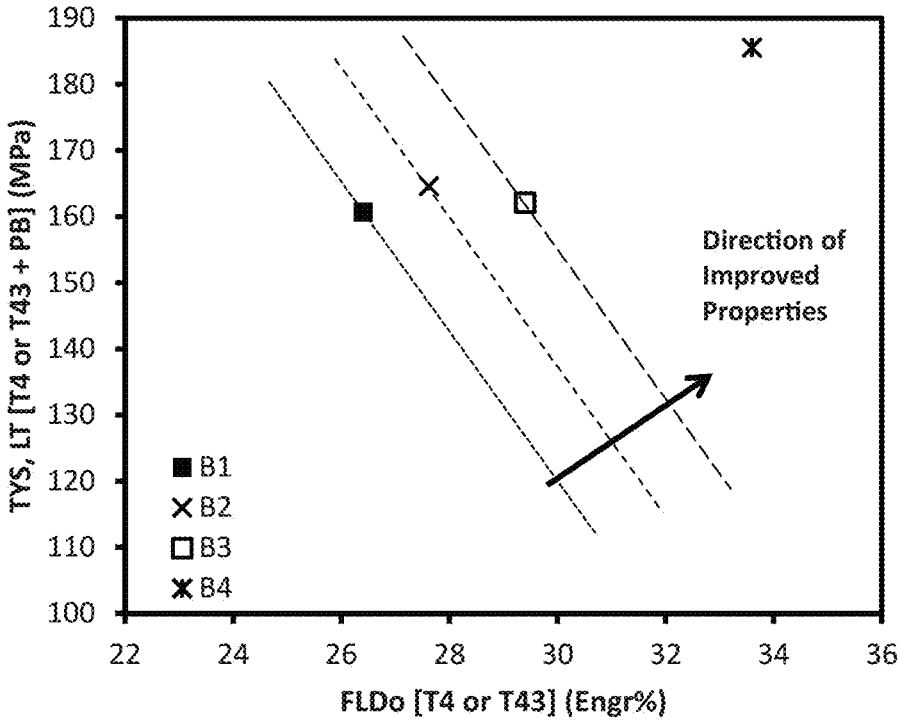
FIG. 4 is a graph showing properties for the Example 2 alloys.

As shown, Alloy B4 achieves a much better combination of strength and formability as compared to Alloys B1-B3. It is believed that Alloy B4 would achieve similar properties when using multiple (>2) hot rolling stands. The data of Table 4 is also presented in FIG. 4.

Example 3

The intergranular corrosion resistance (measured by depth of attack) of alloys A1-A4 and alloy B4 was measured in accordance with ISO standard 11846(1995) (Method B), the results of which are shown below in Table 5. Alloys A1-A4 were in the T43 temper and alloy B4 was in the T4 temper, after which all alloys were artificially aged to near peak strength. As shown in Table 5, below, Alloy B4 realized substantially improved intergranular corrosion resistance over alloys A1-A4.

TABLE 5

Corrosion Resistance Properties

| Material | Depth of Attack (microns) |
|---|---|
| A1 | 386 |
| A2 | 393 |
| A3 | 371 |
| A4 | 369 |
| B4 | 233 |

Alloy B4 realized substantially improved intergranular corrosion resistance over alloys A1-A4.

Filiform corrosion tests were also performed on alloys B1, B3, and B4. Alloy B4 realized much better filiform corrosion resistance as compared to alloys B1 and B3.

Example 4

Three additional heat-treatable aluminum alloys were processed in-line by the method of the present invention. The analysis of the melts was as follows:

TABLE 6

Element Percentage by Weight

| Alloy | Si | Fe | Cu | Mn | Mg | Cr | Ti |
|---|---|---|---|---|---|---|---|
| C1 | 1.16 | 0.14 | 0.87 | 0.07 | 0.37 | 0.03 | 0.032 |
| C2 | 1.19 | 0.16 | 0.87 | 0.05 | 0.30 | 0.03 | 0.030 |
| C3 | 1.18 | 0.17 | 0.87 | 0.14 | 0.33 | 0.03 | 0.036 |

The balance of the alloys was aluminum and unavoidable impurities.

Alloy C1 was continuously cast to a thickness of 4.572 mm (0.180 inch) and alloys C2-C3 were continuously cast a thickness of from 3.429 to 3.454 mm (0.135 to 0.136 inch. Alloy C1 was processed in line by hot rolling in two steps with a first stand hot rolling to an intermediate gauge of 3.785 mm (0.149 inch) (a 17% reduction), and a second stand hot rolling to another intermediate gauge of 3.150 mm (0.124 inch) (a 17% reduction). Alloy C1 was then cold rolled to a final gauge of 1.500 mm (0.059 inch) (52.4% cold work), Alloy C2 was processed in line by hot rolling in two steps with a first stand hot rolling to an intermediate gauge of 2.616 mm (0.103 inch) (a 24% reduction), and a second stand hot rolling to a final gauge of 1.500 mm (0.059 inch) (a 42% reduction). Alloy C3 was processed in line by hot rolling in two steps with a first stand hot rolling to an intermediate gauge of 2.591 mm (0.102 inch)(a 25% reduction), and a second stand hot rolling to a final gauge of 1.500 mm (0.059 inch) (a 42% reduction). Alloys C2 and C3 were not cold rolled. After rolling, alloys C1-C3 were then processed to a T4 temper.

The performance of alloys C1-C3 was then evaluated by measuring $FLD_o$ (measured in Engr %) and tensile yield strength (TYS) in the LT direction (measured in MPa) per ASTM B557. $FLD_o$ values were tested in accordance with ISO 12004-2:2008 specification, with the exception that fractures more than 15% of the punch diameter away from the apex of the dome were counted as valid.

TABLE 7

Example 4 Properties

| Alloy | Gauge (mm) | SHT Quench | Temper | $FLD_o$ [T4] (Engr %) | TYS, LT [T4, + PB (2% PS + 356° F./20 min)] (MPa) |
|---|---|---|---|---|---|
| C1 | 1.5 | Water | T4 | 34.5 | 219 |
| C2 | 1.5 | Water | T4 | 33.8 | 195 |
| C3 | 1.5 | Water | T4 | 32.0 | 211 |

Example 5

The second phase particle cluster number density of alloys A1-A4, B4 and C1-C3 in the T4 or T43 temper, as applicable, was measured in accordance with the "Second Phase Particle Cluster Number Density Measurement Procedure", described above, the results of which are shown in Table 8, below.

TABLE 8

Second Phase Particle Cluster Number Density Measurements

| Alloy | Cluster number density (clusters/mm$^2$) | $FLD_o$ (per above examples) (Engr %) | TYS (per above examples) (MPa) |
|---|---|---|---|
| A1 | 3255 | 26.3 | 156 |
| A2 | 4184 | 26.2 | 155 |
| A3 | 2928 | 27.6 | 165 |
| A4 | 4041 | 27.8 | 121 |
| B4 | 6155 | 33.6 | 186 |
| C1 | 6323 | 34.5 | 219 |
| C2 | 6320 | 33.8 | 195 |
| C3 | 7719 | 32.0 | 211 |

Figure 5A:
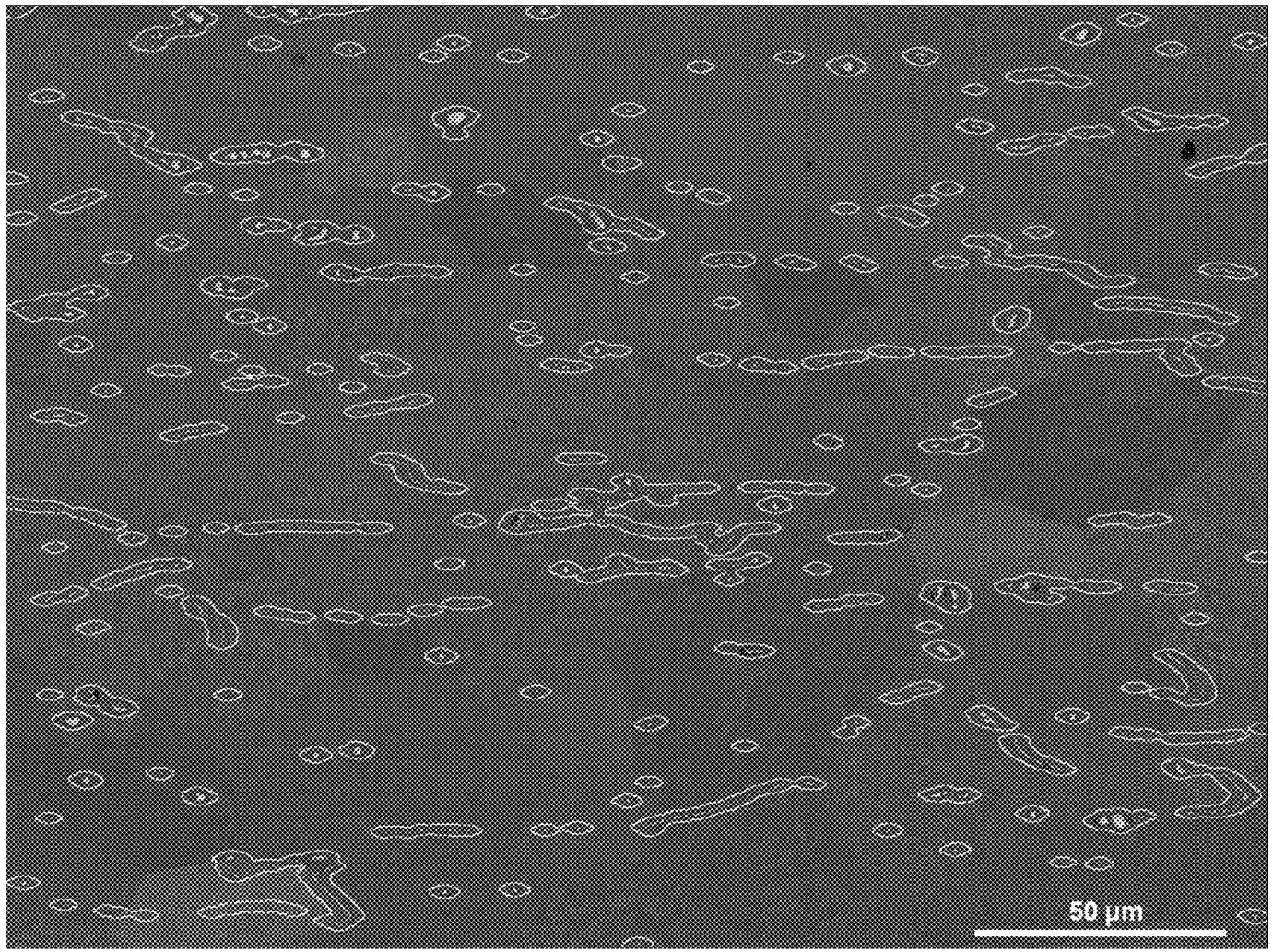
FIG. 5*a* is a photomicrograph of alloy A1 and FIG. 5*b* is a photomicrograph of alloy C1 showing second phase particle clusters, as per Example 5 of the patent application.
Figure 5B:
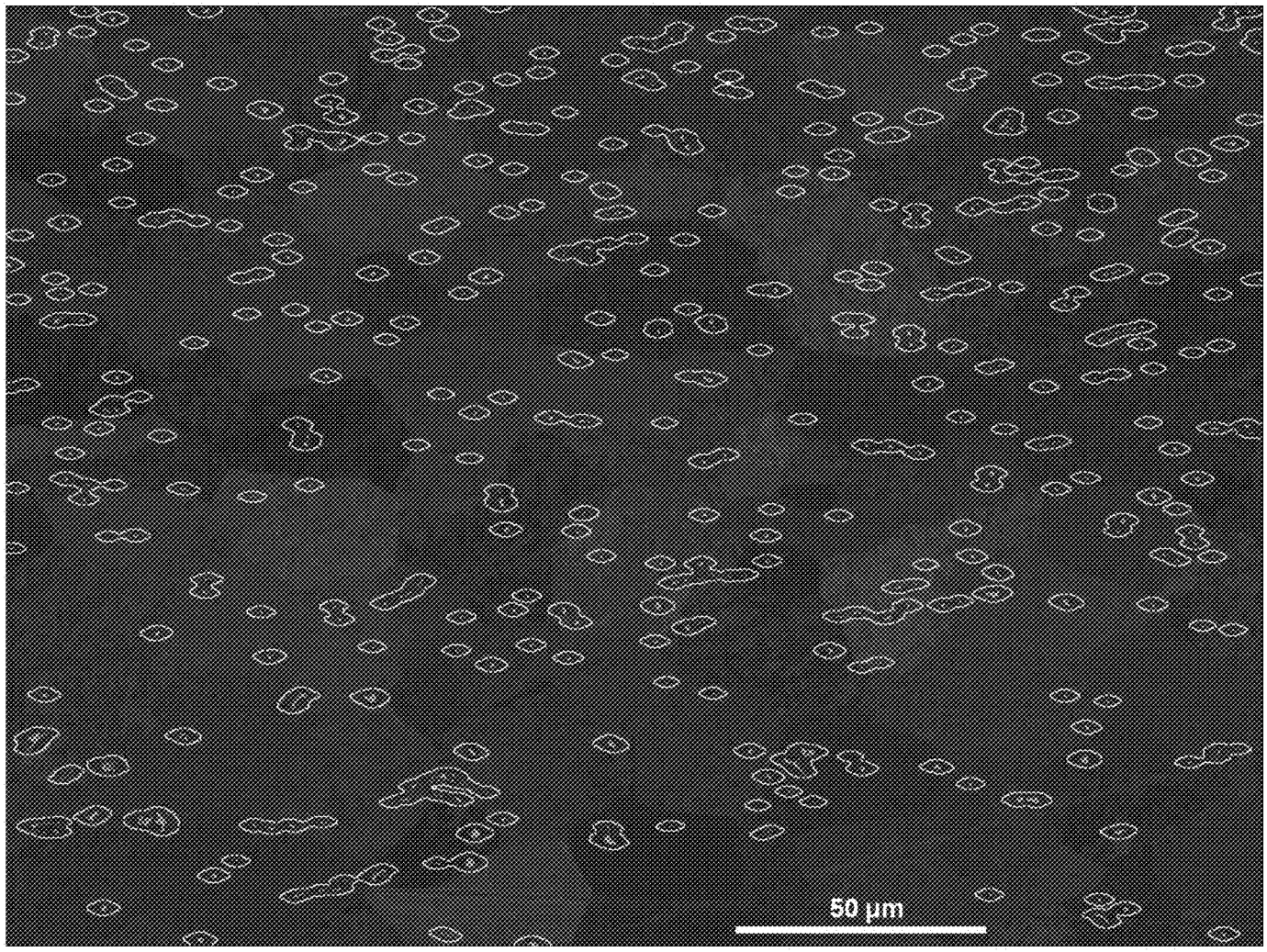
Figure 6:
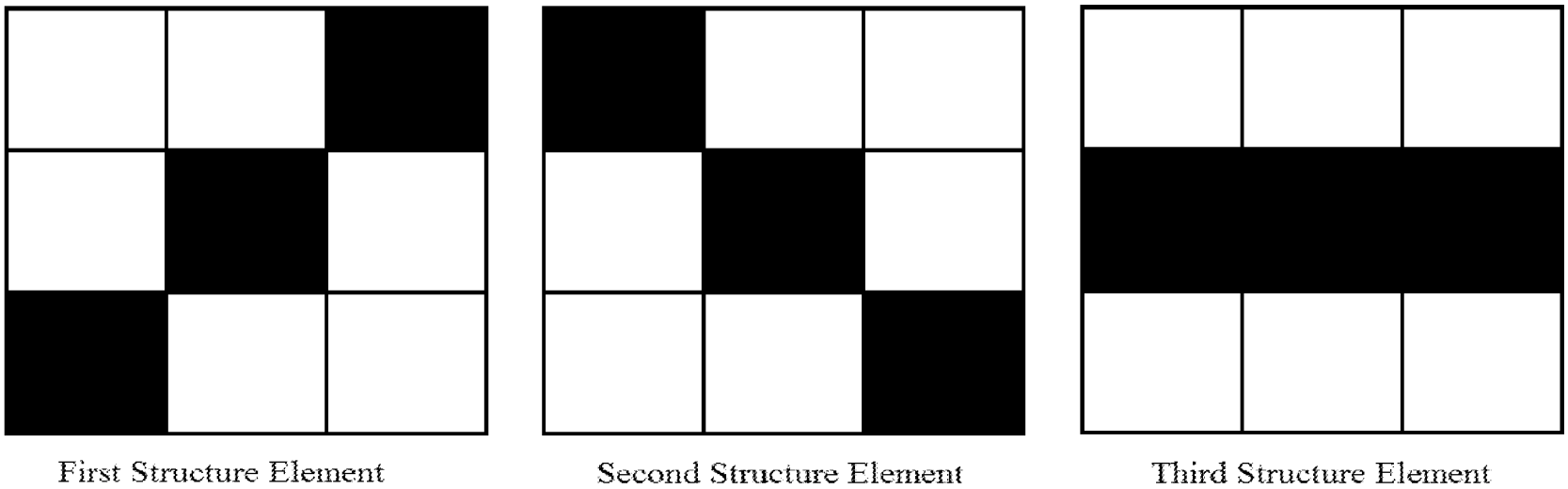
FIG. 6 shows three structure elements for item 5 of the Second Phase Particle Cluster Number Density procedure.

As shown, the new 6xxx aluminum alloys having an improved combination of strength and formability generally have a large cluster number density. As described above, agglomeration/bunching of second phase particles into clusters may be detrimental to the formability properties of the alloy. A large cluster number density indicates that the second phase particles are less agglomerated/bunched in the alloy, which may be beneficial to formability. FIGS. 5*a* and 5*b* are photomicrographs showing the clusters for two alloys, A1 and C1 respectively. As shown, alloy C1 has much less agglomeration/bunching of second phase particles.

Example 6

R values in the L, LT and 45° directions were measured for various ones of the above example alloys, the results of which are shown in Table 9, below.

TABLE 9

R value Measurement

| Alloy | R value L | R value LT | R value 45 | Delta R |
|---|---|---|---|---|
| B1 | 0.75 | 0.58 | 0.46 | 0.20 |
| B3 | 0.78 | 0.57 | 0.44 | 0.24 |
| B4 | 0.75 | 0.74 | 0.80 | 0.06 |
| C1 | 0.75 | 0.70 | 0.79 | 0.07 |
| C2 | 0.73 | 0.77 | 0.77 | 0.02 |
| C3 | 0.76 | 0.76 | 0.79 | 0.03 |

As used herein, "R value" is the plastic strain ratio or the ratio of the true width strain to the true thickness strain as defined in the equation r value=εw/εt. The R value is measured using an extensometer to gather width strain data during a tensile test while measuring longitudinal strain with an extensometer. The true plastic length and width strains are then calculated, and the thickness strain is determined from a constant volume assumption. The R value is then calculated as the slope of the true plastic width strain vs true plastic thickness strain plot obtained from the tensile test. "Delta R" is calculated based on the following equation (1):

$$\text{Delta } R = \text{Absolute Value}[(r_L + r_LT - 2*r_45)/2] \quad (1)$$

where r_L is the R value in the longitudinal direction of the aluminum alloy product, where r_LT is the R value in the long-transverse direction of the aluminum alloy product, and where r_45 is the R value in the 45° direction of the aluminum alloy product.

As shown, the invention alloys (B4, C1-C3) realized a much lower Delta R than the non-invention alloys, meaning the invention alloys have more isotropic properties than the non-invention alloys. In one embodiment, the new 6xxx aluminum alloys described herein realize a Delta R of not greater than 0.10. In another embodiment, the new 6xxx aluminum alloys described herein realize a Delta R of not greater than 0.09. In yet another embodiment, the new 6xxx aluminum alloys described herein realize a Delta R of not greater than 0.08. In another embodiment, the new 6xxx aluminum alloys described herein realize a Delta R of not greater than 0.07. In yet another embodiment, the new 6xxx aluminum alloys described herein realize a Delta R of not greater than 0.06. In another embodiment, the new 6xxx aluminum alloys described herein realize a Delta R of not greater than 0.05. In yet another embodiment, the new 6xxx aluminum alloys described herein realize a Delta R of not greater than 0.04, or less.

Whereas particular embodiments of this invention have been described above for purposes of illustration, it will be evident to those skilled in the art that numerous variations of the details of the present invention may be made without departing from the invention as defined in the appending claims.

What is claimed is:

1. A 6xxx aluminum alloy strip ("6AAS") having a thickness of from 0.1524 to 4.064 mm;

wherein the 6AAS consists essentially of 0.8 to 1.25 wt. % Si, 0.2 to 0.6 wt. % Mg, 0.5 to 1.15 wt. % Cu, 0.01 to 0.20 wt. % Mn, 0.01 to 0.3 wt. % Fe; up to 0.30 wt. % Ti; up to 0.25 wt. % Zn; up to 0.15 wt. % Cr; and up to 0.18 wt. % Zr, the balance being aluminum and impurities;

wherein the 6AAS realizes an average second phase particle cluster number density of at least 4300 clusters per mm$^2$.

2. The 6xxx aluminum alloy strip of claim 1, wherein the 6xxx aluminum alloy strip realizes a Delta R of not greater than 0.10.

3. The 6xxx aluminum alloy strip of claim 1, wherein the 6xxx aluminum alloy strip in the T6 temper realizes a longitudinal tensile yield strength of from 160 to 350 MPa.

4. The 6xxx aluminum alloy strip of claim 1, wherein the 6xxx aluminum alloy strip in the T4 temper realizes a longitudinal tensile yield strength of from 100 to 200 MPa.

5. The 6xxx aluminum alloy strip of claim 1, wherein the 6xxx aluminum alloy strip realizes a $FLD_o$ of 28.0 to 35.0 (Engr %), wherein the $FLD_o$ is measured at a gauge of 1.0 mm.

6. The 6xxx aluminum alloy strip of claim 1, wherein the 6AAS realizes an average second phase particle cluster number density of at least 4500 clusters per mm$^2$.

7. The 6xxx aluminum alloy strip of claim 1, wherein the 6AAS realizes an average second phase particle cluster number density of at least 5000 clusters per mm$^2$.

8. The 6xxx aluminum alloy strip of claim 1, wherein the 6AAS realizes an average second phase particle cluster number density of at least 5500 clusters per mm$^2$.

9. The 6xxx aluminum alloy strip of claim 1, wherein the 6AAS realizes an average second phase particle cluster number density of at least 6000 clusters per mm$^2$.

10. The 6xxx aluminum alloy strip of claim 9, wherein the 6AAS realizes all of:

(i) a Delta R of not greater than 0.10; and (ii) an $FLD_o$ of at least 30.0 (Engr %) in a T4 temper, wherein the $FLD_o$ is measured at a gauge of 1.0 mm; and (iii) a TYS of at least 180 MPa in a T6 temper.

11. The 6xxx aluminum alloy strip of claim 10, wherein the 6AAS realizes a depth of attack of not greater than 300 microns when tested in accordance with ISO 11846 (1995).

* * * * *